US005494395A

United States Patent [19]

Raunisto

[11] Patent Number: 5,494,395

[45] Date of Patent: Feb. 27, 1996

[54] DRIVING MACHINE WITH AN ARTICULATED BOOM

[76] Inventor: Yrjö Raunisto, Anttilankatu 13, FIN-13210 Hämeenlinna, Finland

[21] Appl. No.: 211,481

[22] PCT Filed: Oct. 8, 1992

[86] PCT No.: PCT/FI92/00270

§ 371 Date: Apr. 6, 1994

§ 102(e) Date: Apr. 6, 1994

[87] PCT Pub. No.: WO93/07342

PCT Pub. Date: Apr. 15, 1993

[30] Foreign Application Priority Data

Oct. 8, 1991 [FI] Finland ..... 914735

[51] Int. Cl.[6] ..... E02F 3/39

[52] U.S. Cl. ..... 414/694; 414/728; 52/118

[58] Field of Search ..... 414/685, 694, 414/722, 728, 718, 912, 727, 695.5; 52/118, 115; 212/115, 300

[56] References Cited

U.S. PATENT DOCUMENTS

| | | | |
|---|---|---|---|
| 3,465,904 | 9/1969 | Pensa | 414/694 |
| 4,102,461 | 7/1978 | Soyland | 414/694 |
| 4,964,778 | 10/1990 | Muto et al. | 414/728 X |
| 5,092,733 | 3/1992 | Kishi . | |

FOREIGN PATENT DOCUMENTS

| | | | |
|---|---|---|---|
| 72167 | 12/1986 | Finland . | |
| 196876 | 6/1965 | Sweden . | |
| 1299953 | 3/1987 | U.S.S.R. | 414/722 |

*Primary Examiner*—Donald W. Underwood
*Attorney, Agent, or Firm*—Larson and Taylor

[57] ABSTRACT

A driving machine includes an articulated boom to which a scoop, bulldozer plate, loader or a similar tool is attachable. The articulated boom has a first arm which is articulated to slew around a joint in another arm of the boom in order to carry out the folding motion of the boom. In addition, the first arm is movable inside the other arm to carry out a telescopic motion.

8 Claims, 3 Drawing Sheets

DRIVING MACHINE WITH AN ARTICULATED BOOM

FIELD OF THE INVENTION

The invention relates to a driving machine with an articulated boom, which can be converted into an excavator, a tractor loader, a loader or a lifting truck.

BACKGROUND OF THE INVENTION

In known articulated boom constructions, one or more arms, attached to each other in succession, are slewed by a hydraulic cylinder. A fulcrum pin connection is used to attach the arms, which allows adjacent arms to slew on one level with respect to each other. Usually, the arms are rigid and the farthest one, as viewed from the driving machine, is furnished with a device adaptable to carry out jobs. In addition to the rigid arms, there are telescopically extendable arms by which the reach is increased.

The above presented prior boom solutions lack the convertibility which is required when a multi-arm boom of an excavator is converted into loader use, in which mainly one arm is needed. It is, of course, possible to carry out loading with an excavator, but moving with a heavy load is difficult, since the load must be carried and supported by long arms which are far from the driving machine, which must rest on its wheels or tracks. On loading or lifting, the load must be brought as close to the driving machine as possible at least during the time of transportation.

SUMMARY OF THE INVENTION

With the solution according to the invention, a decisive improvement on the convertibility of a boom is achieved. The invention is characterized in what is presented in the patent claims.

The most important advantages of the invention are that with the same boom construction qualities are achieved which are required of a tractor loader as well as qualities required of a lifting truck. By means of the boom, the load can be brought close to or far away from the driving machine, according to need. In addition, the boom construction has an effect of increasing the machine stability, which leads to one further advantage, i.e. the driving machine can be made lighter than previously known devices.

BRIEF DESCRIPTION OF THE DRAWINGS

In the following the invention is defined more closely with reference to the drawings, where.

DESCRIPTION OF THE PREFERRED EMBODIMENTS

Figure 1:
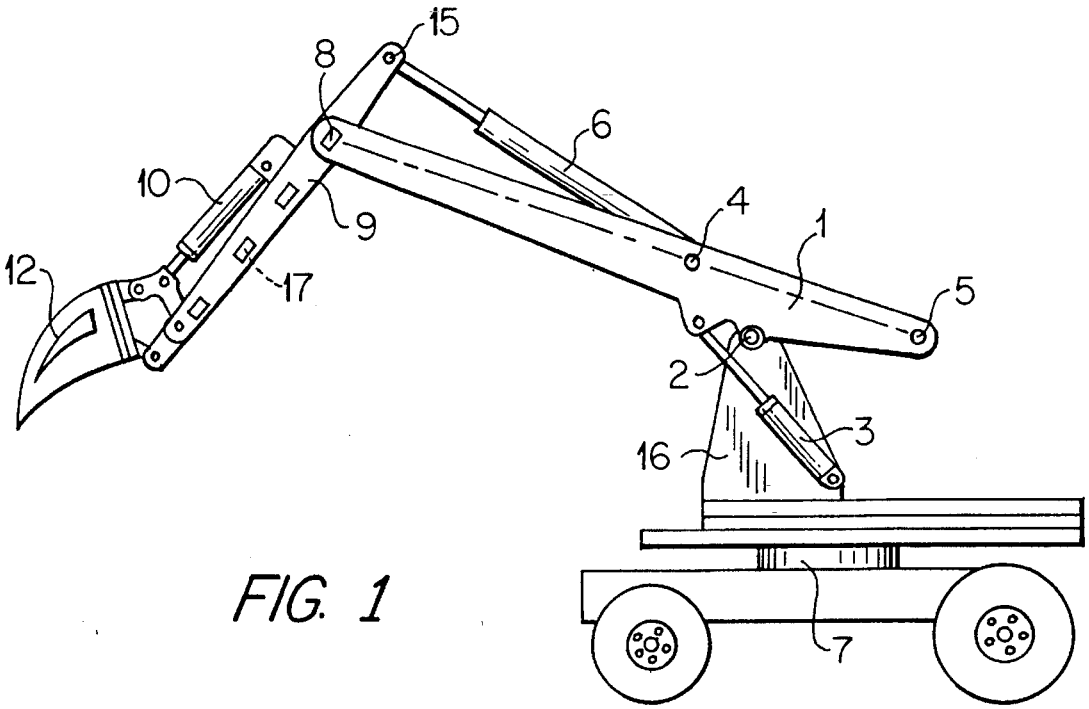
FIG. 1 is a side-view of an excavator.

FIG. 1 shows a simplified drawing of an excavator with a slewing gear 7 in the upper body. On the upper body the boom can be moved forward and backward with a movable support element 16. Lifting arm 1 is attached to the support element 16 with joint 2 and cylinder 3 moves the lifting arm. There are two attachment points 4, 5 in lifting arm 1 for attachment of the folding cylinder 6 rear end. Folding arm 9 is articulated in the lifting arm upper end with joint 8. In the folding arm 9 a scoop cylinder 10 is mounted for scoop 12 operation. On both sides of the folding arm 9 there are guiding pieces 17 as per FIG. 5. With this construction the driving machine is a reaching excavator.

Figure 2:
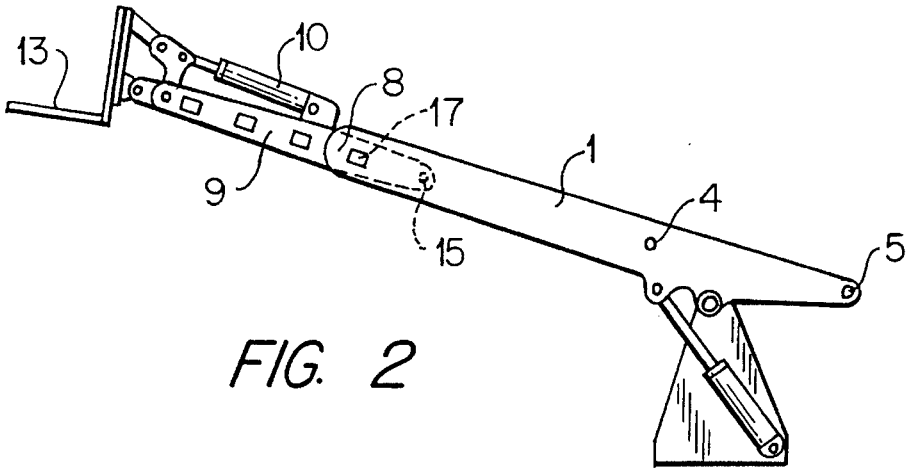
FIG. 2 is the boom.

FIG. 2 shows the same boom, in the top of which the scoop has been replaced with forks 13 of a lifting truck. With cylinder 6, attached with its rear end to point 4, the folding arm has been pulled in line with lifting arm 1. With the arms in line, the locking of articulation point 8 opens and guiding piece 17 can slide from sliding point 8 in line with arm 1 pulled by cylinder 6. In the state as per FIG. 2, the guiding piece 17 and, accordingly, also arm 9 have moved some distance into arm 1. Additional guides may be used, because cylinder 6, for example, cannot pull folding arm 9 completely in the direction of arm 1. In a situation as per FIG. 2 with the folding arm sufficiently supported by the guides, such as guiding pieces 17, the attachment of the cylinder 6 rear end is shifted to point 5. It can be done hydraulically by pushing when the other end 15 of the cylinder 6 is firmly locked. The cylinder rear end is locked in point 5 and arm 9 released for motion. Arm 9 is then telescopically movable inside arm 1.

Figure 3:
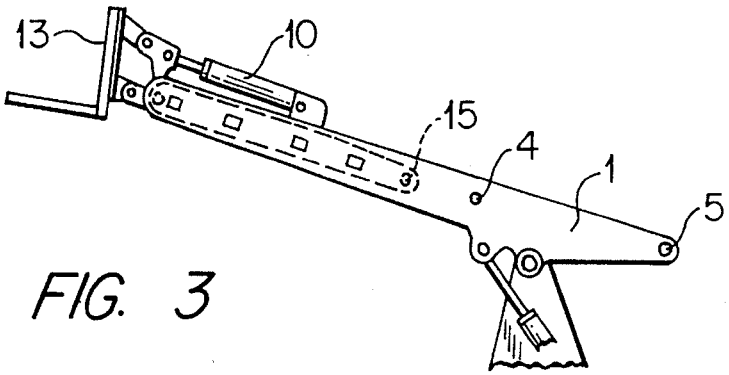
FIG. 3 is a retracted boom.

FIG. 3 shows arm 9 completely inserted into arm 1 and the boom at its shortest.

Figure 4:
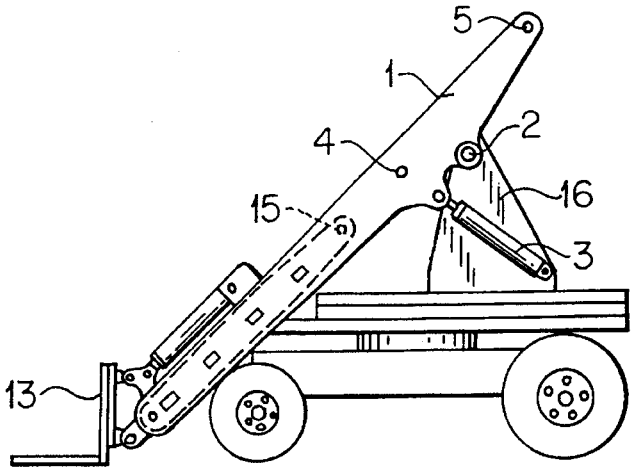
FIG. 4 is a retracted boom in a driving machine.

FIG. 4 is a simplified drawing of a high-reaching lifting truck. As can be seen in the figure, the construction is well adaptable to a loader and a high-reaching lifting truck, since the load can be transported quite close to the driving machine during shifting and, if necessary, lifted up, whereby the load still remains close to the driving machine.

Figure 5:
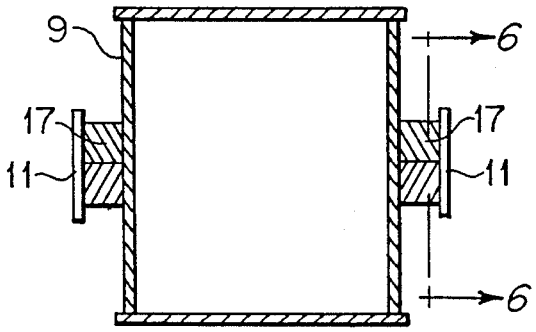
FIG. 5 is a cross-section of a folding arm.

FIG. 5 shows a cross-section of folding arm 9 viewed from the point of the guiding pieces 17. The guiding pieces 17 have a flange part 11 to ensure that they stay in the guides and also to bind the sides of the folding arm 9 together preventing them from bursting in stress situations. Advantageously, the real sliding surfaces are of cast iron.

Figure 6:
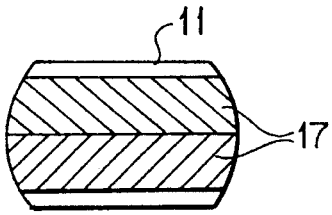
FIG. 6 is a cross-section of a sliding piece.

FIG. 6 shows a cross-section of guiding pieces 17 formed of two joined bars, the distance of which outer flanks is dimensioned according to the distance of the guides. The end surface of the guiding pieces 17 are parts of cylinder surfaces.

Figure 7:
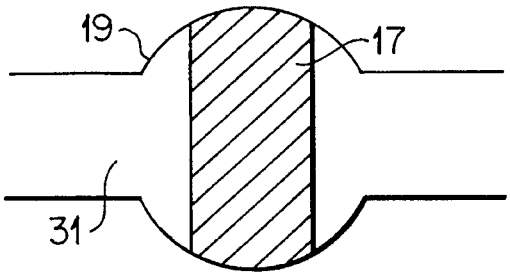
FIG. 7 is a sliding piece in the point of articulation.

FIG. 7 shows schematically a seating 19 of the pivoted joint 8 in the top of arm 1. The seating is cylindrical and includes a rectangular opening 31 formed therein adjacent the outer end of arm 1. A guiding piece 17 connected to arm 9 glides into the seating 19 through the opening 31 when arms 1 and 9 are in line. The guides 18 (FIG. 8) extend to the rectangular opening so that when the guiding piece has reached seating 19, the effect of other arm 9 guiding parts ceases and arm 9 is free to slew with respect to arm 1 and, immediately, guiding piece 17 in seating 19 starts, as the only supporting element of the slewing of arm 9 in articulation point 8, bearing the slewing.

Figure 8:
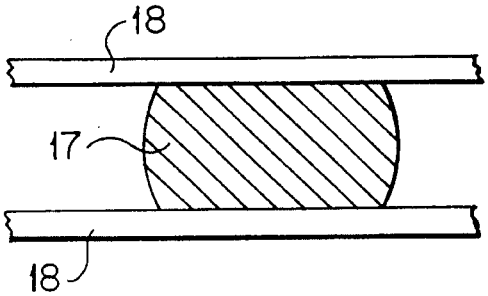
FIG. 8 is a sliding piece between guides.

FIG. 8 shows a portion of guides 18 inside arm 1, in which guiding pieces 17 guide the telescopic movement of arm 9 inside arm 1. The guides also guide the guiding part 17, which is bearing the slewing of arm 17, so that it is directed accurately into the seating. During the telescopic movement, several guiding pieces 17 glide through seating 19 and there are at least two pairs of guiding pieces in the guides at the same time so as to sustain the arm 9 direction. On extruding arm 9 into a folding state, the last pair of guiding pieces 17 in the arm surface enter seating 19 and then the arm can be slewed by cylinder 6.

Figure 9:
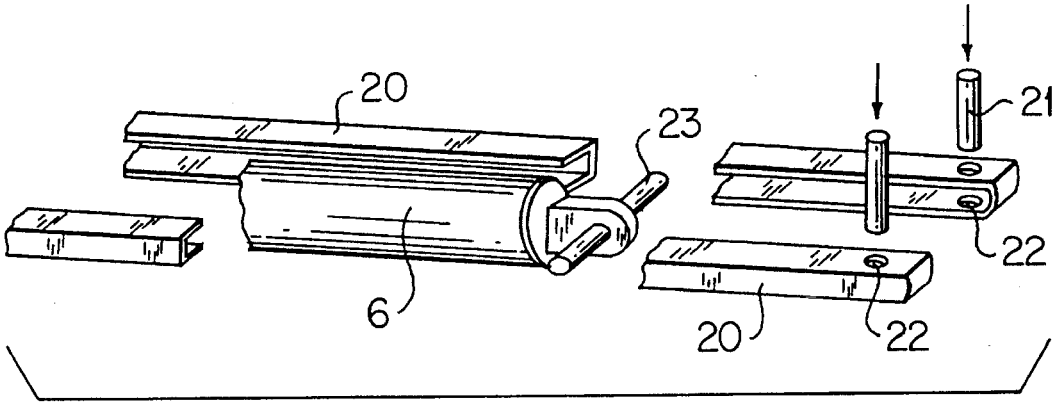
FIG. 9 is a cylinder locking.

FIG. 9 shows a system for locking the rear attachment of cylinder 6 and for shifting the attachment into another point. The fulcrum pin 23 of the rear attachment of the cylinder is long and guiding bars 20 have been arranged for it. The guiding bars 20 can have many locking points. The figure shows the farthest rear locking, which is effected with locking pins when pin 23 has reached holes 22 in bars 20. With a corresponding pin and hole system, the locking point can be made in any place on the bars.

Figure 10:
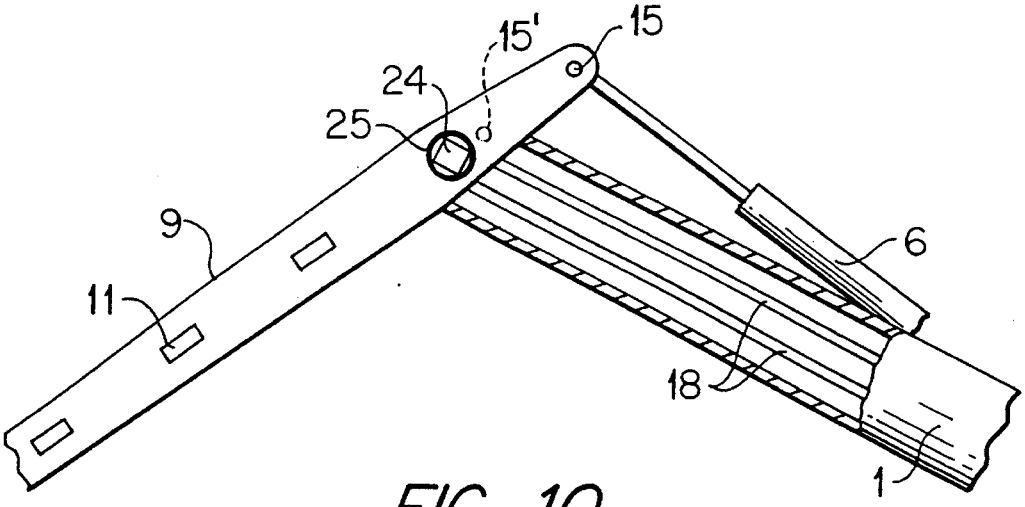
FIG. 10 is a boom solution.

FIG. 10 shows an alternative to the configuration described in connection with FIGS. 7 and 8, which utilizes a pivoted joint, the fulcrum pin of which is fastened bearing 25 in arm 9. At the end of the fulcrum pin there are square quadrangular guiding pieces 24, which guide in guides 18. Guiding pieces 24 are locked to the end of arm 1 by some known means on using arm 9 folding motion. There is another attachment point 15' for cylinder 6, also in arm 9, which is used during the telescopic motion of arm 9.

Figure 11:
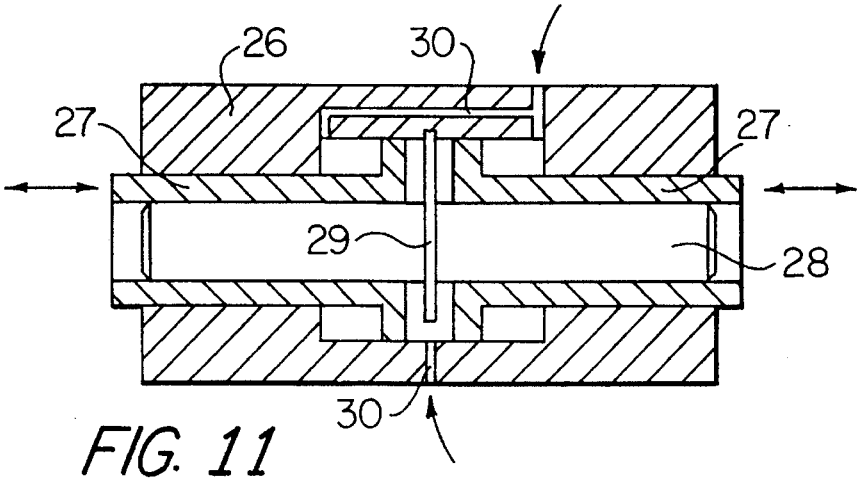
FIG. 11 is a hydraulic locking pin.

FIG. 11 shows a locking pin which may be used, for example, to replace pin 23 at the end of cylinder 6 (FIG. 9). The locking pin is operated by fluid pressure, the bushings 27 of which extrude and are inserted by means of fluid pressure. The device has a body 26 and a guiding pin 28 and a support 29 keeping the guiding pin 28 in a middle position.

Many locking and fulcrum pin modifications as well as solutions for the guiding elements of the telescopic arm 9 as it glides inside arm 1 are possible within the frames of the presented patent claims.

I claim:

1. A driving machine having an articulated boom for working with a tool, the articulated boom comprising:

a first arm mounted on said driving machine and having a joint at one end thereof and guides extending along a length thereof; and a second arm supported by said first arm by means of guiding pieces positioned at points along a length of said second arm, said guiding pieces movably supported by said joint and said guides, said second arm having at least one position with respect to said first arm wherein said second arm is supported by said first arm at said joint by the guiding pieces at only one of said points and said second arm is pivotable about the joint for performing a folding motion, said second arm being movable inside said first arm by movement of said guiding pieces in said guides when said second arm is pivoted in line with said first arm for performing a telescoping motion.

2. A driving machine according to claim 1 further comprising a locking pin in said first arm for locking said second arm at positions along said first arm during telescopic movement of said second arm.

3. A driving machine according to claim 2 wherein said locking pin comprises a hydraulically operated pin.

4. A driving machine according to claim 1 further comprising a cylinder attached to said first arm and to said second arm for moving said second arm with respect to said first arm.

5. A driving machine according to claim 4 wherein said first arm includes at least a first attachment point for attachment of said cylinder during the folding motion of said second arm and at least a second attachment point for attachment of said cylinder during the telescoping motion of said second arm.

6. A driving machine according to claim 1 wherein said joint comprises a cylindrical seating having an opening formed therein adjacent an outer end of the first arm for communicating with said guiding pieces.

7. A driving machine according to claim 6 wherein said opening comprises a rectangular shaped opening.

8. A driving machine according to claim 1 wherein two guiding pieces are positioned at each of said points on said second arm on opposite sides thereof.

* * * * *